US006382918B1

(12) United States Patent
Tang

(10) Patent No.: US 6,382,918 B1
(45) Date of Patent: May 7, 2002

(54) BLADE BRACKET MOUNTING SYSTEM FOR CEILING FAN

(76) Inventor: David Tang, No. 3, Nong 5, Lane 66, Yang-Ming Street, Feng-Yuan City, Taichung Hsien (TW)

( * ) Notice: Subject to any disclaimer, the term of this patent is extended or adjusted under 35 U.S.C. 154(b) by 0 days.

(21) Appl. No.: 09/680,097

(22) Filed: Oct. 6, 2000

(51) Int. Cl.[7] ..... F04D 29/34

(52) U.S. Cl. ..... 416/210 R; 416/204 R; 416/205; 416/220 A

(58) Field of Search ..... 416/5, 204 R, 416/205, 207, 210 R, 214 R, 220 A

(56) References Cited

U.S. PATENT DOCUMENTS 5,927,945 A * 7/1999 Chen ..... 416/5
6,010,306 A * 1/2000 Bucher et al. ..... 416/210 R
6,042,339 A * 3/2000 Blateri et al. ..... 416/210 R
6,048,173 A * 4/2000 Chen ..... 416/210 R
6,095,753 A * 8/2000 Hsu ..... 416/210 R
6,139,276 A * 10/2000 Blateri et al. ..... 416/210 R
6,261,064 B1 * 7/2001 Tang ..... 416/210 R

* cited by examiner

*Primary Examiner*—Christopher Verdier
(74) *Attorney, Agent, or Firm*—Charles E. Baxley

(57) ABSTRACT

A blade bracket mounting system for a ceiling fan includes a support base having a plurality of locking portions each having three locking slots each having a first end defining a wide portion and a second end defining a narrow portion, a plurality of blade brackets each provided with a connection secured on the locking portion of the support base, and provided with three slide blocks each slidably mounted in the locking slot of the locking portion, three locking screws each screwed in the slide block and each slidably rested on the wall of the locking slot, and a fastening ring mounted on the support base and provided with a plurality of limit lugs. Two adjacent limit lugs each have a corner secured in the cavity of the connection of the blade bracket so that the blade bracket is rigidly secured on the support base.

2 Claims, 6 Drawing Sheets

BLADE BRACKET MOUNTING SYSTEM FOR CEILING FAN

BACKGROUND OF THE INVENTION

1. Field of the Invention

The present invention relates to a blade bracket mounting system, and more particularly to a blade bracket mounting system for a ceiling fan.

2. Description of the Related Art

A conventional blade bracket mounting system for a ceiling fan in accordance with the prior art shown in FIG. 6 comprises a motor rotor 60 defining a plurality of screw holes 62, a plurality of blade brackets 61 each secured on the support base 60 and each having an extension 64 defining a plurality of through holes 640, and a plurality of screws 63 each extending through the through hole 640 and screwed into the screw hole 62, thereby securing the blade brackets 61 to the support base 60.

However, the user has to respectively extend each of the screws 63 through the respective through hole 640 of the extension 64 of each of the blade brackets 61 and to respectively screw each of the screws 63 into the respective screw hole 62 of the support base 60 so that the user needs much manual work and has to spend a great deal of time. In addition, the user has to additionally provide a tool such as a screwdriver for operating the screws 63, thereby causing inconvenience to the user.

SUMMARY OF THE INVENTION

The present invention has arisen to mitigate and/or obviate the disadvantage of the conventional blade bracket mounting system for a ceiling fan.

In accordance with one aspect of the present invention, there is provided a blade bracket mounting system for a ceiling fan comprising:

a support base including an annular flange defining an axial hole, and a plurality of locking portions each located beside the annular flange, each of the locking portions including three locking slots each having a first end defining a wide portion and a second end defining a narrow portion;

a plurality of blade brackets each secured on the support base and each having one distal end provided with a connection secured on a respective locking portion of the support base, the connection defining a cavity and provided with three slide blocks each slidably mounted in a respective locking slot of the locking portion, three locking screws each screwed in a respective one of the three slide blocks to slide therewith and each slidably rested on a wall of a respective locking slot of the locking portion, each of the three locking screws having a dimension greater than that of the narrow portion of the locking slot so that the locking screw is detachably urged on a wall of the narrow portion of the locking slot; and a fastening ring secured on the support base and including a ring portion mounted on the annular flange of the support base and defining a fitting hole for receiving the annular flange, the ring portion of the fastening ring having an outer periphery provided with a plurality of limit lugs and defining a plurality of openings between the limit lugs, two adjacent limit lugs each having a corner secured in the cavity of the connection of the blade bracket so that the blade bracket is rigidly secured on the support base.

Further benefits and advantages of the present invention will become apparent after a careful reading of the detailed description with appropriate reference to the accompanying drawings.

DETAILED DESCRIPTION OF THE INVENTION

Figure 1:
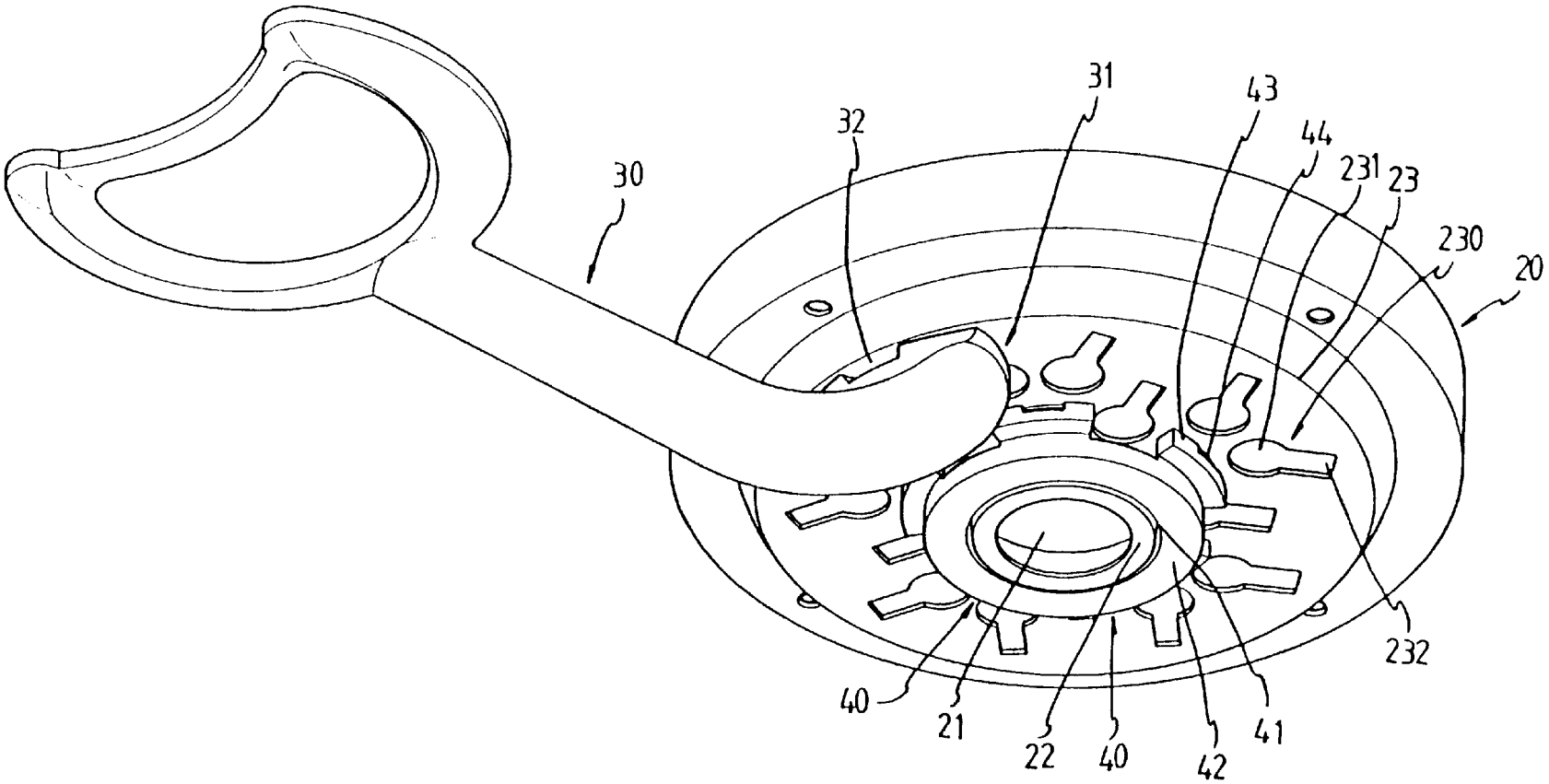
FIG. 1 is a perspective view of a blade bracket mounting system for a ceiling fan in accordance with the present invention.

Referring to the drawings and initially to FIGS. 1–4, a blade bracket mounting system for a ceiling fan in accordance with the present invention comprises a support base 20, a plurality of blade brackets 30, and a flexible fastening ring 40.

The support base 20 is constructed with the bearing seat (not shown) of the motor (not shown) of the ceiling fan and includes an annular flange 22 protruding outward and defining an axial hole 21, and a plurality of locking portions 23 each located beside the annular flange 22. Each of the locking portions 23 includes three locking slots 230 each having a first end defining a circular wide portion 231 and a second end defining a rectangular narrow portion 232.

Figure 4:
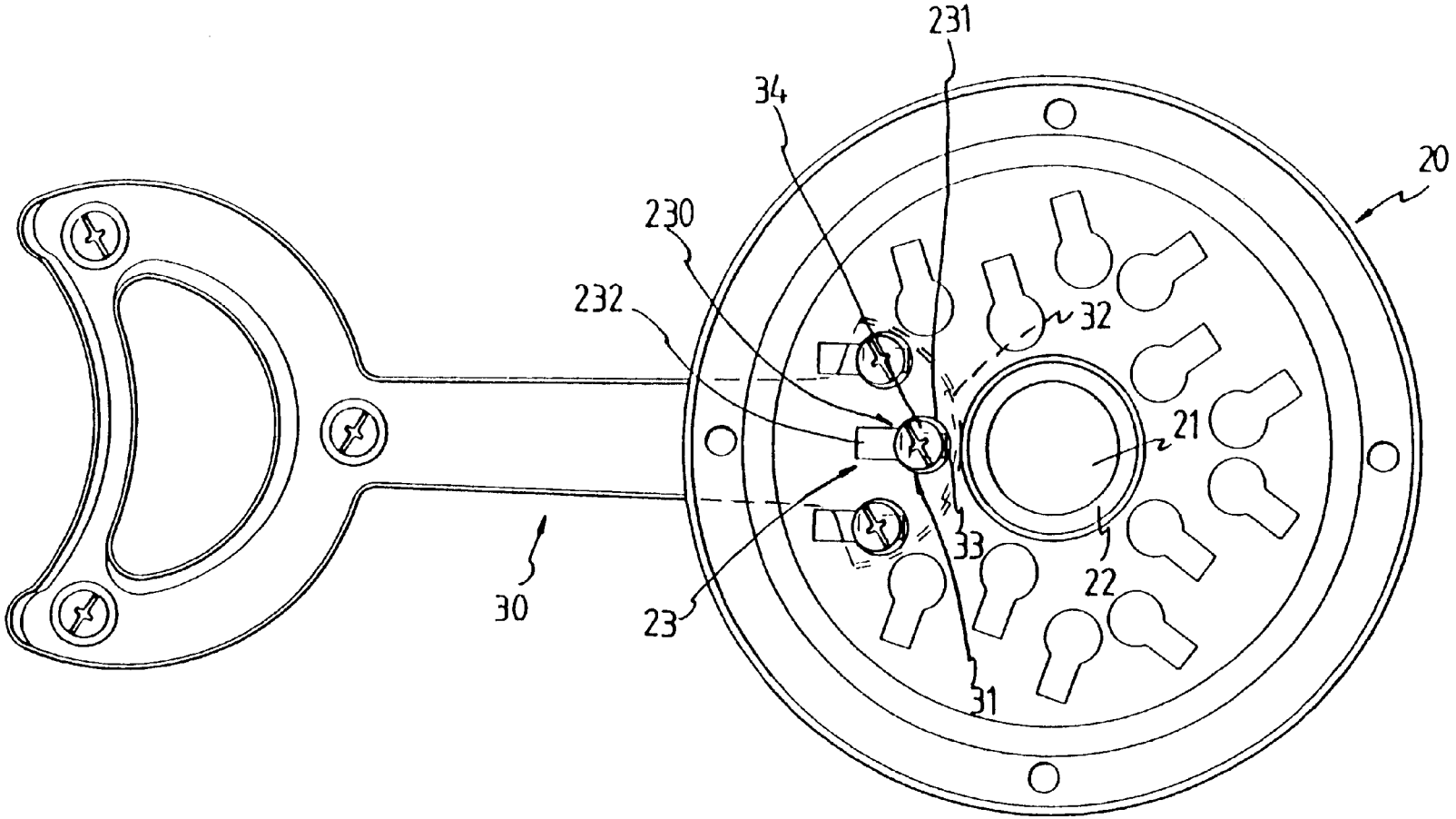
FIG. 4 is a top plan view of the blade bracket mounting system for a ceiling fan as shown in FIG. 1.

Each of the blade brackets 30 is secured on the support base 20 and each has a first end connected with a blade (not shown) and a second end provided with a connection 31 secured on a respective locking portion 23 of the support base 20. The connection 31 defines a cavity 32 and includes three rectangular slide blocks 33 each slidably mounted in the locking slot 230 of the locking portion 23. Three locking screws 34 are each screwed in a respective one of the three slide blocks 33 to slide therewith and are each slidably rested on the wall of a respective locking slot 230 of the locking portion 23 as shown in FIG. 4. Each of the three locking screws 34 has a diameter just minorly smaller than that of the circular wide portion 231 of the locking slot 230 and greater than the width of the rectangular narrow portion 232 of the locking slot 230 so that the locking screw 34 is detachably urged on the wall of the narrow portion 232 of the locking slot 230.

The flexible fastening ring 40 is secured on the support base 20 and includes a ring portion 42 mounted on the annular flange 22 of the support base 20 and defining a fitting hole 41 for receiving the annular flange 22. The ring portion 42 of the fasten ring 40 has an outer periphery provided with a plurality of limit lugs 43 and defining a plurality of openings 45 between the limit lugs 43. Any two adjacent limit lugs 43 of the fastening ring 40 each have a corner 431 secured in the cavity 32 of the connection 31 of the blade bracket 30 as shown in FIG. 3 so that the blade bracket 30 is rigidly secured on the support base 20.

Figure 2:
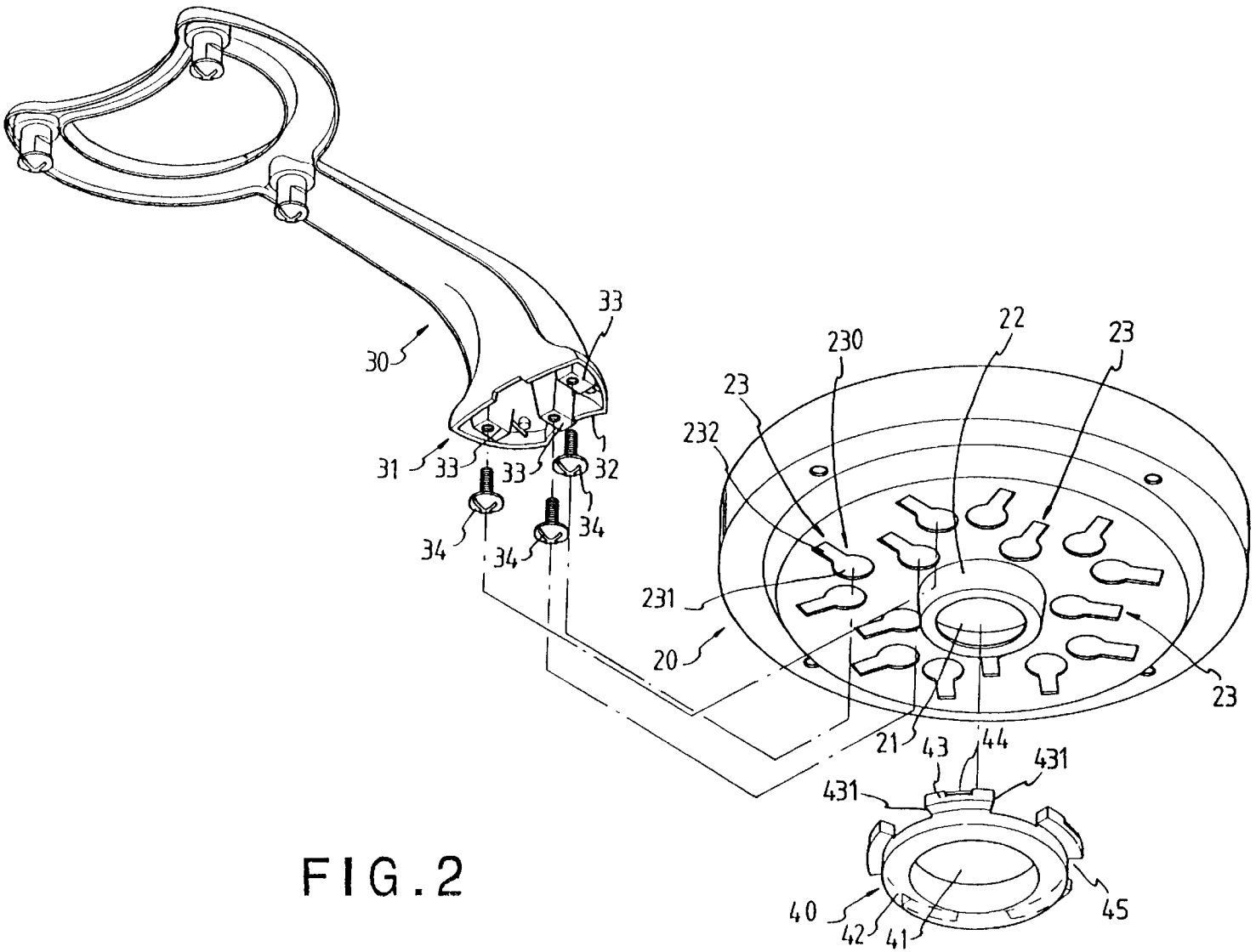
FIG. 2 is an exploded view of the blade bracket mounting system for a ceiling fan as shown in FIG. 1.
Figure 3:
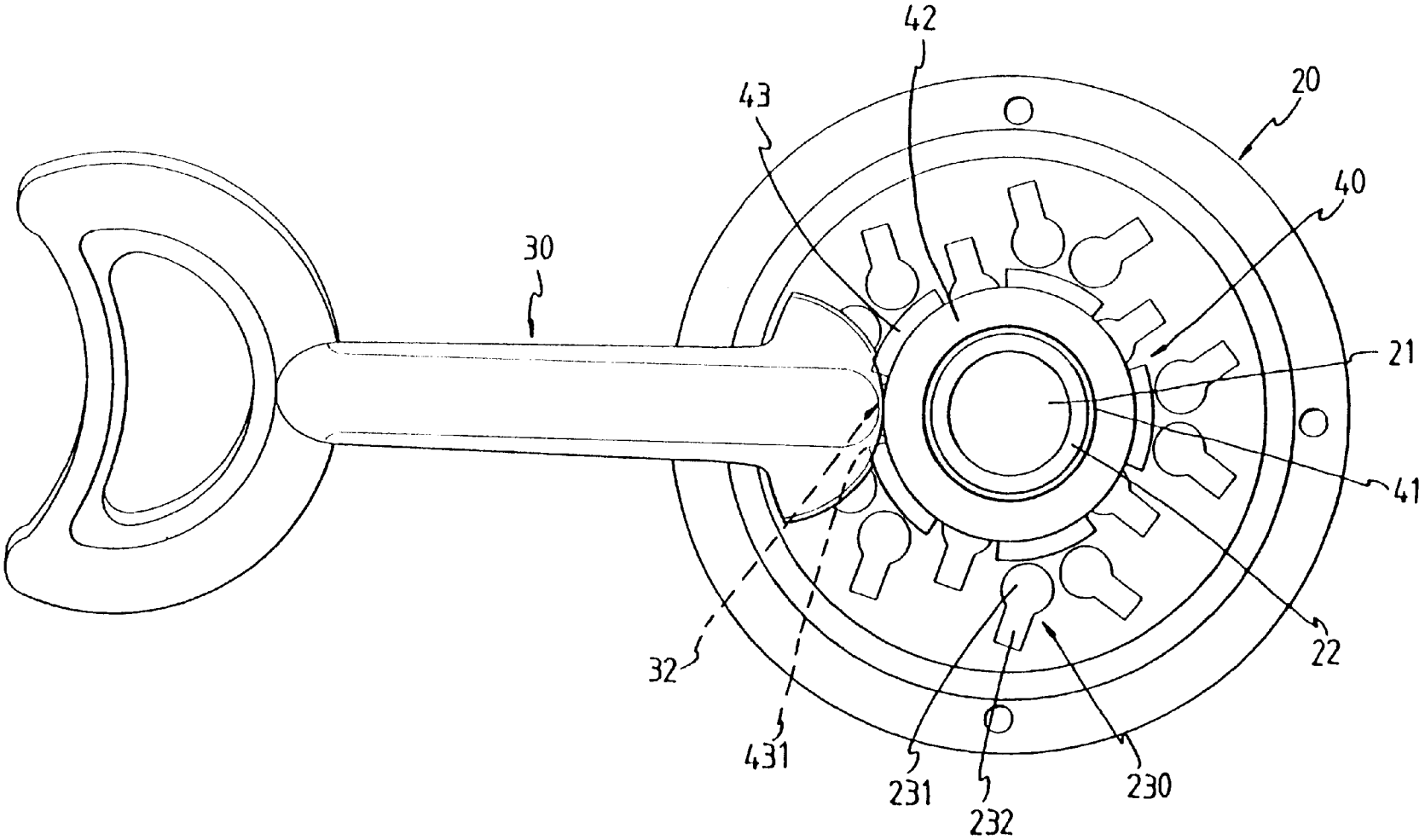
FIG. 3 is a bottom plan view of the blade bracket mounting system for a ceiling fan as shown in FIG. 1.
Figure 5:
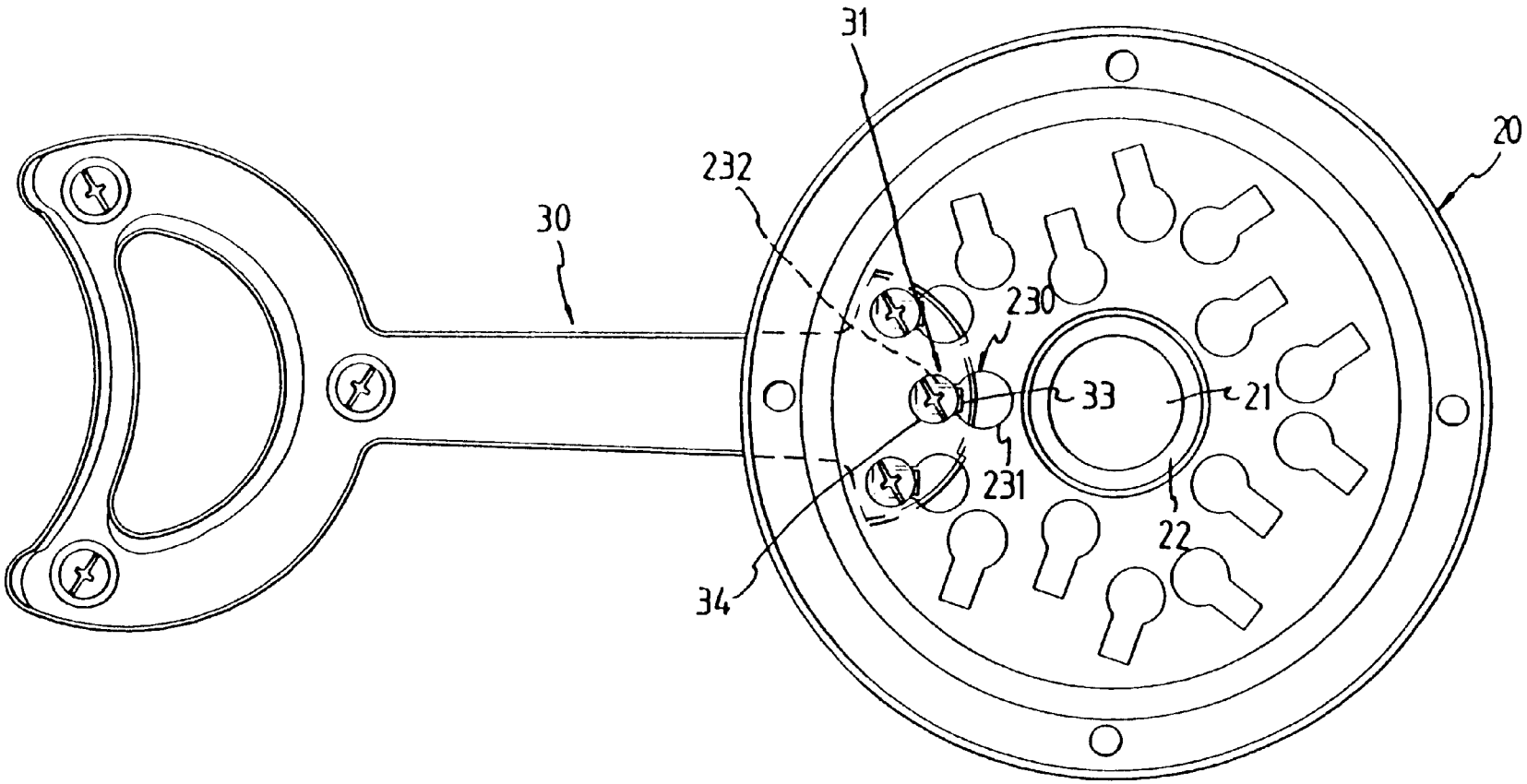
FIG. 5 is an operational view of the blade bracket mounting system for a ceiling fan as shown in FIG. 4.
Figure 6:
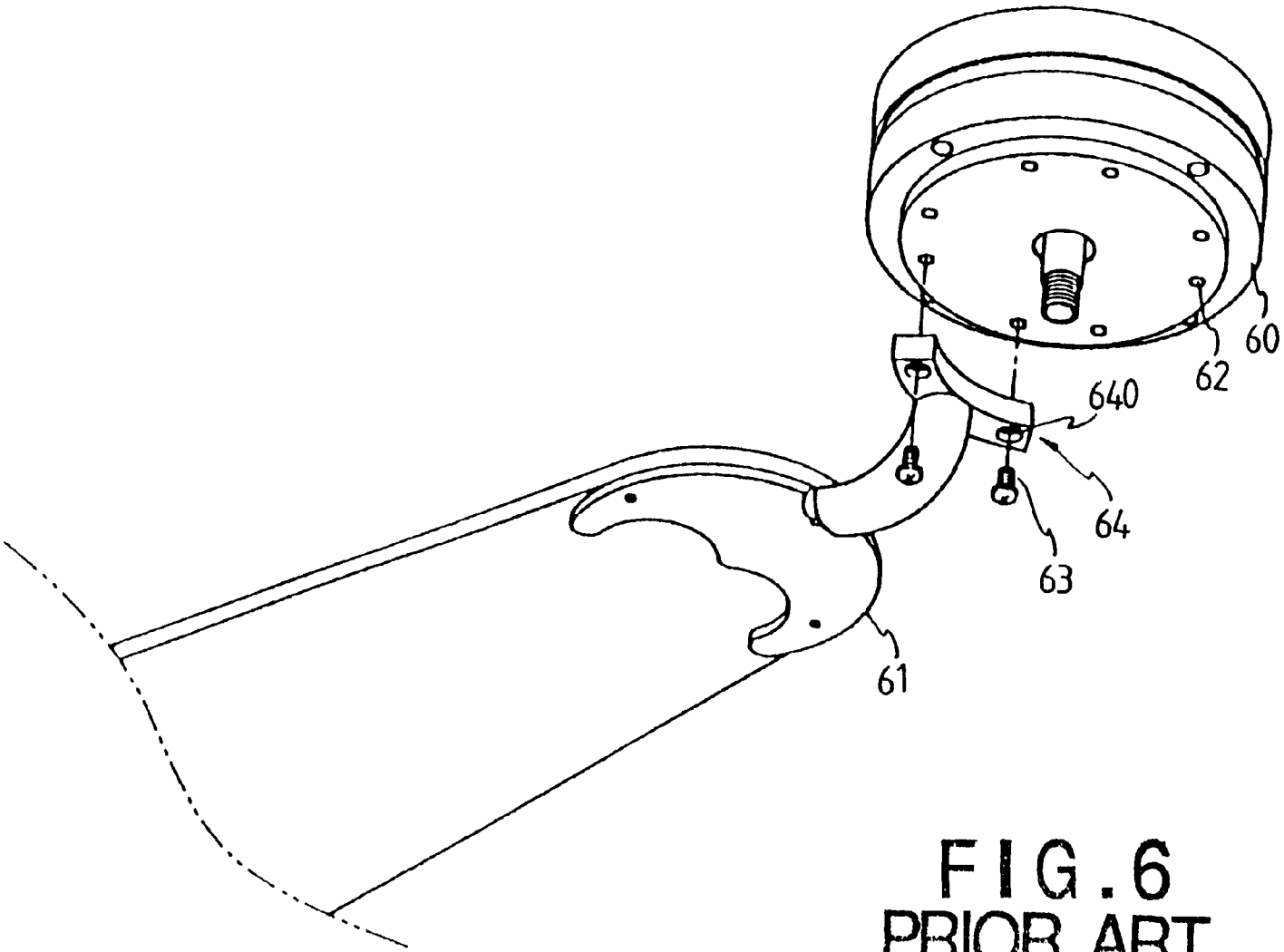
FIG. 6 PRIOR ART
FIG. 6 is an exploded view of a conventional blade bracket mounting system for a ceiling fan in accordance with the prior art.

In operation, referring to FIGS. 4 and 5 with reference to FIGS. 1–3, each of the locking screws 34 is initially inserted into the circular wide portion 231 of the respective locking slot 230 as shown in FIG. 4.

The blade bracket 30 is then moved outward relative to the support base 20 to move the connection 31 therewith so that each of the slide blocks 33 together with the respective locking screws 34 is moved in the locking slot 230 from the position as shown in FIG. 4 to the position as shown in FIG. 5 where the slide block 33 is received in the narrow portion 232 of the locking slot 230 while the locking screw 34 is urged on the wall of the narrow portion 232 of the locking slot 230 so that the blade bracket 30 is rigidly and stably secured on the support base 20.

The blade bracket 30 can be moved toward the support base 20 whereby each of the slide blocks 33 together with the respective locking screws 34 is moved in the locking slot 230 from the position as shown in FIG. 5 to the position as shown in FIG. 4 so that the slide block 33 together with the locking screws 34 can be detached from the circular wide portion 231 of the locking slot 230, thereby detaching the blade bracket 30 from the support base 20.

In such a manner, the blade bracket 30 can be easily and quickly mounted on and detached from the support base 20 without having to additionally provide a tool such as a screwdriver or the like, thereby saving time and manual work, and thereby greatly facilitating the user assembling and dismantling the blade bracket 30 and the support base 20.

When the blade brackets 30 are respectively mounted on the support base 20, the fastening ring 40 can be mounted on annular flange 22 of the support base 20 with the corners 431 of any two adjacent limit lugs 43 being secured in the cavity 32 of the connection 31 of the blade bracket 30 as shown in FIG. 3 so that the blade bracket 30 is rigidly secured on the support base 20.

Preferably, each of the limit lugs 43 of the ring portion 42 of the fasten ring 40 defines a recess 44 therein whereby the user can insert a small slotted driver into the recess 44 for driving the fastening ring 40, thereby facilitating the user removing the fasten ring 40 from the support base 20.

It should be clear to those skilled in the art that further embodiments may be made without departing from the scope of the present invention.

What is claimed is:

1. A blade bracket mounting system for a ceiling fan comprising:

a support base (20) including an annular flange (22) defining an axial hole (21), and a plurality of locking portions (23) each located beside said annular flange (22), each of said locking portions (23) including three locking slots (230) each having a first end defining a wide portion (231) and a second end defining a narrow portion (232);

a plurality of blade brackets (30) each secured on said support base (20) and each having one distal end provided with a connection (31) secured on a respective locking portion (23) of said support base (20), said connection (31) defining a cavity (32) and provided with three slide blocks (33) each slidably mounted in a respective locking slot (230) of said locking portion (23), three locking screws (34) each screwed in a respective one of said three slide blocks (33) to slide therewith and each slidably rested on a wall of a respective locking slot (230) of said locking portion (23), each of said three locking screws (34) having a dimension greater than that of a respective narrow portion (232) of said locking slots (230) so that each said locking screw (34) is detachably urged on a wall of said respective narrow portions (232) of said locking slots (230); and a fastening ring (40) secured on said support base (20) and including a ring portion (42) mounted on said annular flange (22) of said support base (20) and defining a fitting hole (41) for receiving said annular flange (22), said ring portion (42) of said fastening ring (40) having an outer periphery provided with a plurality of limit lugs (43) and defining a plurality of openings (45) between said limit lugs (43), two adjacent limit lugs (43) each having a corner (431) secured in said cavity (32) of said connection (31) of said blade bracket (30) so that said blade bracket (30) is rigidly secured on said support base (20).

2. The blade bracket mounting system for a ceiling fan in accordance with claim 1, wherein each of said limit lugs (43) of said ring portion (42) of said fastening ring (40) defines a recess (44) therein.

* * * * *